US006807893B2

(12) United States Patent
Giddens

(10) Patent No.: US 6,807,893 B2
(45) Date of Patent: Oct. 26, 2004

(54) JACKET-ASSEMBLY AND METHOD FOR PROTECTING HYDRAULIC ELEVATOR JACKS

(75) Inventor: Blaine Giddens, Senatobia, MS (US)

(73) Assignee: Thyssen Elevator Capital Corp., Whittier, CA (US)

( * ) Notice: Subject to any disclaimer, the term of this patent is extended or adjusted under 35 U.S.C. 154(b) by 0 days.

(21) Appl. No.: 10/214,003

(22) Filed: Aug. 6, 2002

(65) Prior Publication Data

US 2002/0189440 A1 Dec. 19, 2002

Related U.S. Application Data

(63) Continuation of application No. 09/608,310, filed on Jun. 30, 2000, now Pat. No. 6,427,575.

(51) Int. Cl.[7] ..... F01B 25/26; F01B 7/20
(52) U.S. Cl. ..... 92/5 R; 92/51; 92/77
(58) Field of Search ..... 92/5 R, 51, 77

(56) References Cited

U.S. PATENT DOCUMENTS 5,076,146 A * 12/1991 Bialy et al. ..... 92/86
5,501,299 A * 3/1996 Holmes ..... 92/144
6,427,575 B1 * 8/2002 Giddens ..... 92/5 R

OTHER PUBLICATIONS

Green, Richard; Modern Plastics Encyclopedia, Oct. 1991; McGraw–Hill Inc.; vol. 68, No. 11; p. 378.*

* cited by examiner

*Primary Examiner*—Edward K. Look
*Assistant Examiner*—Michael Leslie
(74) *Attorney, Agent, or Firm*—Frost Brown Todd LLC

(57) ABSTRACT

A jacket-assembly is sealed to a hydraulic elevator jack to protect the jack from corrosion. The jacket-assembly is preferably manufactured from a non-galvanic, non-corrosive material. The jacket may be manufactured from any non-galvanic, non-corrosive material that is strong enough and flexible enough to be factory-installed on the jack, i.e., installed on the jack at a location other than the location where the jack is to be installed, and survive shipping and installation of the jack. The jacket is preferably hermetically sealed to the jack. The jacket-assembly may contain a bulkhead mounted on the hydraulic elevator jack having an O-ring groove. An O-ring can be used to effect a hermetic seal between the bulkhead and the jacket. The bulkhead may be mounted on the jack with any conventional means. In one embodiment, a moisture sensor may be placed inside the jacket.

12 Claims, 4 Drawing Sheets

JACKET-ASSEMBLY AND METHOD FOR PROTECTING HYDRAULIC ELEVATOR JACKS

This application is a continuation of application Ser. No. 09/608,310, filed Jun. 30, 2000, now U.S. Pat. No. 6,427,575.

BACKGROUND OF THE INVENTION

1. Field of the Invention

The present invention relates to hydraulic elevator jacks. In particular, the present invention provides a jacket-assembly and method for protecting a hydraulic elevator jack from moisture that is typically encountered when a hydraulic elevator jack is placed in contact with the ground or when a hydraulic elevator jack is used in subterranean applications. The present invention also provides an apparatus and method for alerting maintenance personnel when sufficient moisture has penetrated the jacket-assembly to start corrosion.

2. Description of Related Art

Corrosion of hydraulic elevator jacks is a significant problem because corrosion not only shortens the life of the jack but also presents a significant safety concern. A corroded elevator jack is more likely to have a catastrophic failure that can result in injury to elevator passengers and significant damage to an elevator system. Hydraulic elevator jacks are, unfortunately, often used in environments conducive to corrosion.

To combat corrosion, some elevator manufacturers have developed polyvinyl chloride ("PVC") liners for their elevator jacks. While a PVC liner will protect a jack from exposure to moisture and from contact with the ground, PVC is a brittle material. For example, PVC typically has an Izod Impact resistance of between 0.5 and 1.5 ft-lbs/inch (measured in accordance with the ASTM D 256-97 protocols). Because PVC has a low Izod Impact resistance, PVC liners are susceptible to fracture and special care must be used in handling PVC liner systems. In general, hermetically sealed PVC liner systems must be installed at a jobsite because they lack the toughness and ductility to be factory-installed (i.e., installed on a jack prior to shipping it to a jobsite) and to survive the rigors of shipping and installation while on a jack. Moreover, PVC has a temperature utilization range of approximately 14° to 140° F., making PVC liner systems unsuitable for use in climates that have extreme high or low temperatures. A further shortcoming of prior art PVC liner systems is that they often require complicated monitoring systems to ensure that significant moisture has not breached the liner, or they require complicated means for preventing moisture from reaching the hydraulic jack.

It is thus an object of the present invention to provide a hermetically sealed jacket-assembly that effectively protects hydraulic elevator jacks from corrosion due to moisture, regardless of the source of that moisture, and that can, in one embodiment, be installed on a hydraulic elevator jack prior to shipping the jack to a jobsite where it will be installed, i.e., factory-installed on a hydraulic elevator jack. It is a further object of the present invention to provide an apparatus and method for monitoring whether moisture has breached the jacket-assembly. It is also an object of the present invention to provide an apparatus and method for testing the seal of a jacket-assembly both at the factory and in the field during and after installation.

SUMMARY OF THE INVENTION

The present invention provides a jacket-assembly and method for protecting a hydraulic elevator jack from corrosion by preventing the corrosion process from beginning. In one embodiment, the invention also provides an assembly and method for alerting elevator maintenance personnel when corrosion of a hydraulic elevator jack is imminent. Thus, the present invention eliminates the possibility of catastrophic jack failure by corrosion. In one embodiment, the present invention provides an assembly and method for isolating a hydraulic elevator jack from moisture by surrounding it with a non-corrosive, non-galvanic jacket, such as a piece of polyethylene tubing, and hermetically sealing the jacket to the jack. The invention thus isolates the hydraulic elevator jack from contact with the ground or other surfaces conducive to corrosion and electrolytic action. A moisture sensor may be inserted between the jacket and the jack. In elevator systems having sophisticated control systems, the moisture sensor may be wired to the elevator controller so that the moisture within the jacket-assembly may be monitored.

In a particular embodiment, a jacket-assembly is created by placing a jacket over a portion of a hydraulic elevator jack. The jacket is constructed of a size and shape such that when it is placed over the jack, a space will exist between the jacket and the portion of the hydraulic elevator jack. The jacket-assembly also includes a seal for hermetically sealing the jacket to the hydraulic elevator jack. The jacket is preferably manufactured from a plastic material, such as high density polyethylene, having an Izod Impact resistance of greater than 10 ft-lbs/inch (measured in accordance with method A of the ASTM D 256-97 protocols, which are hereby incorporated by reference) and preferably having a utilization temperature range of −50° to 180° F. In a particular embodiment, the jacket is made from high density polyethylene tubing having a density greater than 0.94 gms/cc, such as Chevron's Plexco® EHMW PE 3408 or Phillips Petroleum's Driscopipe® series 1000, which have densities of approximately 0.96 gms/cc. It, however, will be appreciated by those skilled in the art that any non-corrosive, non galvanic material can be used.

The jacket material should be sufficiently tough and ductile so that, in one embodiment, the jacket-assembly may be installed on and hermetically sealed to the hydraulic elevator jack prior to shipping it to a jobsite where it will be installed. In this regard, the material should be capable of remaining intact and hermetically sealed to the jack during shipping, handling and installation of the hydraulic elevator jack, i.e., it should be capable of being factory-installed on the jack and survive the rigors of shipping and installation without losing its ability to protect the hydraulic elevator jack. Materials having an Izod Impact resistance of greater than 10 ft-lbs/inch are particularly well suited for this application. Moreover, the material used for the jacket-assembly should have a temperature utilization of between −50° and 180° F. to allow the jacket-assembly to be used in virtually any climate where elevators may be found.

In a preferred embodiment, the jacket-assembly includes a bulkhead that is mounted on the jack and that has an outer edge with an O-ring groove. The O-ring groove accommodates an O-ring, which is used to create the hermetic seal between the jacket and the jack. A clamp, preferably installed over the upper end of the jacket, aids in creating the hermetic seal between the jacket and the O-ring and outer edge of the bulkhead. In some applications, a moisture sensor may be installed between the jack and the jacket. The moisture sensor may contain wires that pass through an orifice in the bulkhead with the aid of a wiring-harness-fitting. In sophisticated elevator systems, the moisture sensor can be wired to an elevator control panel so that it may be monitored. In other systems, the moisture sensor may be used by maintenance personnel with appropriate equipment to check whether moisture has penetrated the jacket-assembly. In some embodiments, the jacket-assembly may contain a pressure tester, comprising an air valve, to allow the hermetic seal of the jacket-assembly to be tested. The air valve may be installed in an orifice in the bulkhead.

DETAILED DESCRIPTION OF THE INVENTION

Figure 1:
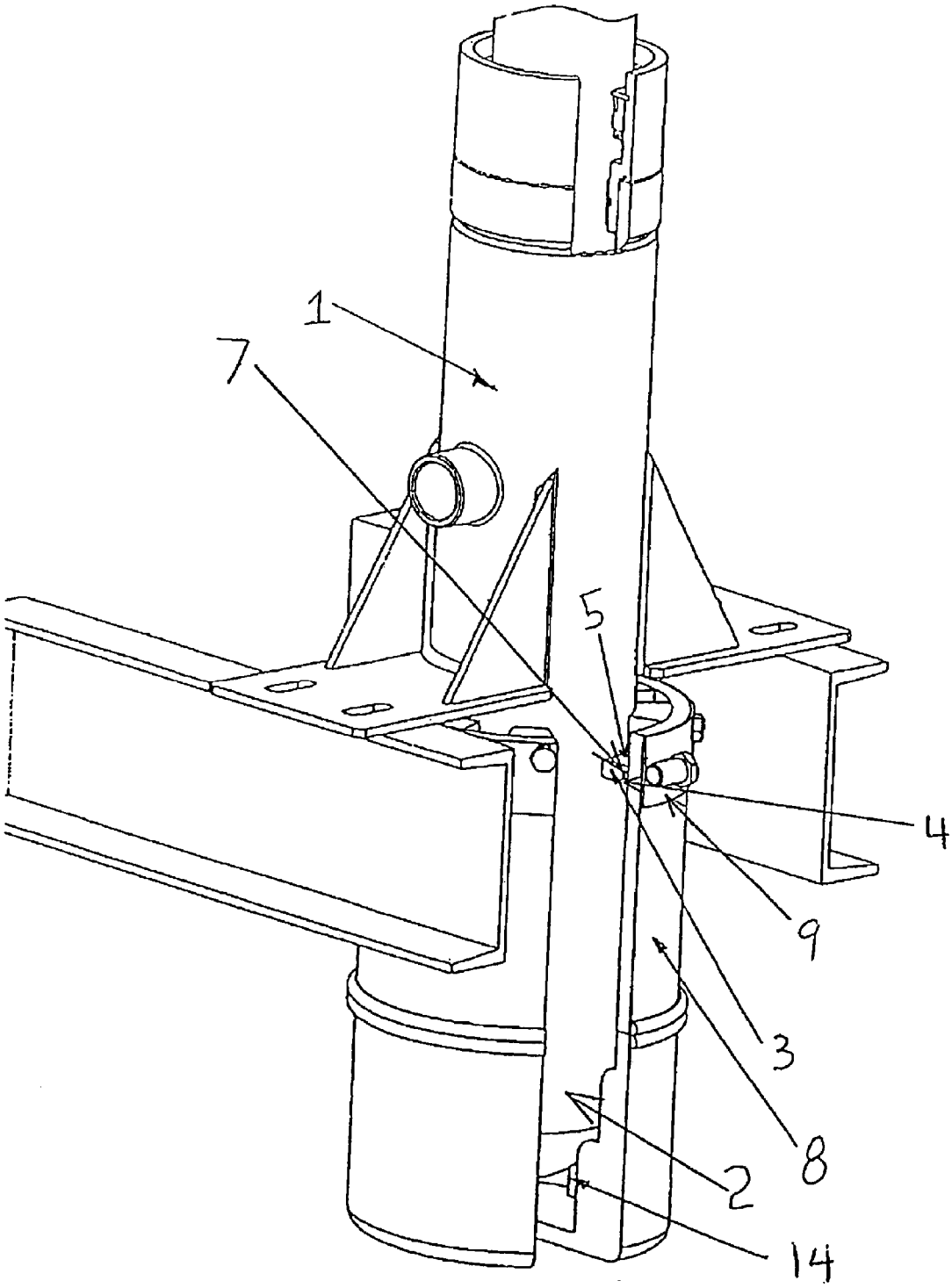
FIG. 1 is a perspective view depicting a hydraulic elevator jack, as is typically mounted in a conventional application, with a jacket-assembly.
Figure 2:
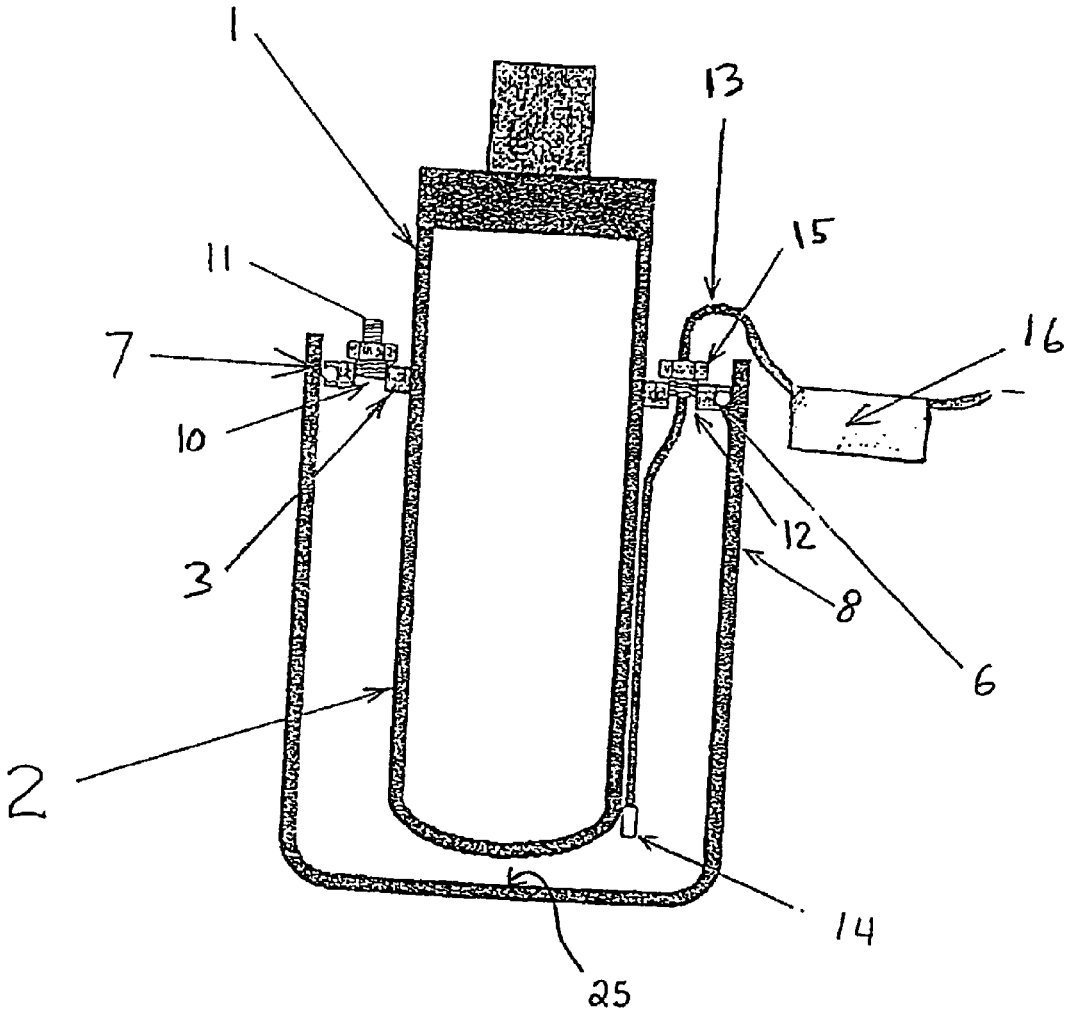
FIG. 2 is vertical cross-section view of a hydraulic elevator jack with a protective jacket-assembly according to the invention.
Figure 3:
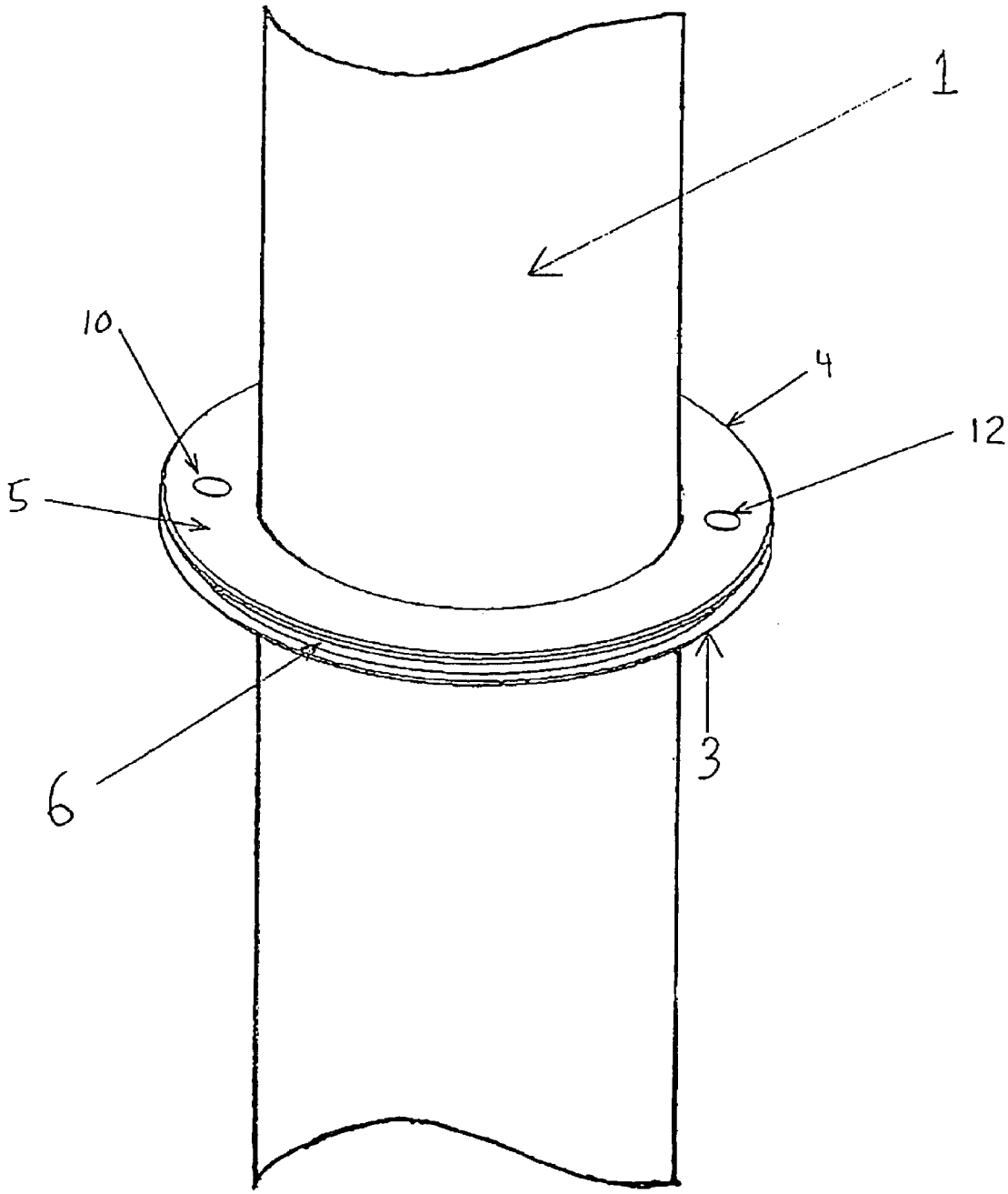
FIG. 3 is a perspective view of a portion of hydraulic elevator jack containing a bulkhead according to the invention.
Figure 4:
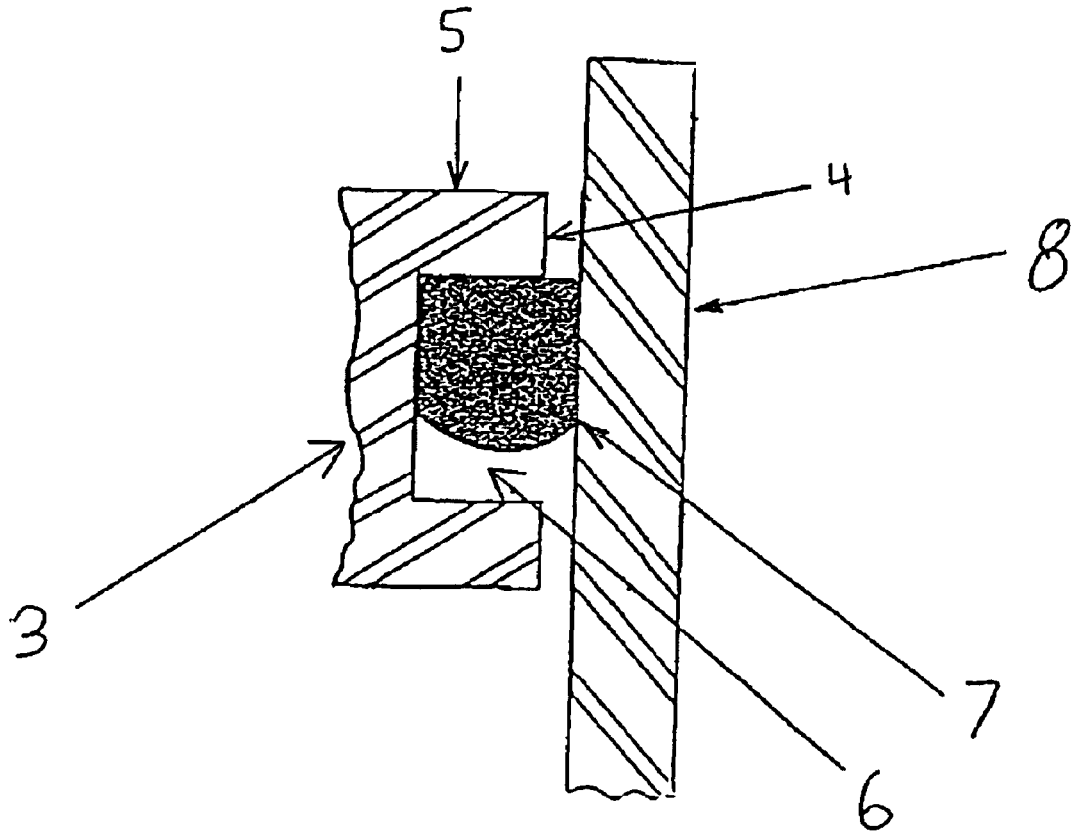
FIG. 4 is an enlarged cross-sectional view of the bulkhead and the components creating a seal between the hydraulic elevator jack and a protective jacket according to the invention.

Referring now to FIG. 1, an elevator jack 1 has a lower end 2. A circular bulkhead 3 is attached to the upper portion of the lower end 2 of the hydraulic elevator jack 3 by any conventional means, such as a weld. The bulkhead 3 has an outer edge 4 and an upper surface 5. As depicted in FIGS. 2, 3, and 4, the bulkhead 3 contains an O-ring groove 6. As shown in FIGS. 1 and 4, an O-ring 7 is inserted in the O-ring groove 6 to provide a hermetic seal between the jack 3 and a jacket 8. In a preferred embodiment, the jacket 8 is constructed from a plastic material, such as high density polyethylene tubing, having an Izod Impact resistance of greater than 10 ft-lbs/in. (when measured in accordance with method A of the ASTM D 256-97 protocols) and preferably a utilization temperature range of −50° to 180° F. Those skilled in the art will appreciate that any non-corrosive, non-galvanic material may be used to construct the jacket 8. Preferably, the material will be flexible and strong enough to be factory-installed—i.e., installed at a location other then the jobsite where the combined jack and jacket will be installed—and thus capable of surviving shipping, handling, and installation without fracturing or otherwise failing to provide a hermetically sealed barrier. Polyethylene having density greater than 0.94 gms/cc is a suitable material for the jacket 8, and best results have been obtained when a high density polyethylene having a density of approximately 0.96 gms/cc is used. Chevron's Plexco® PE 3408 or Phillips Petroleum's Driscopipe® series 1000 are particularly well suited for this application. However, any polyethylene or other material may be used, so long as it is sufficiently rigid and has other mechanical properties necessary to protect the jack 1.

As shown in FIG. 1, a band clamp 9, preferably made from a non-corrosive material, such as stainless steel, clamps around the jacket-assembly in the vicinity of the O-ring groove 6 (see FIGS. 2–4) to create a hermetic seal between the bulkhead 3, which is welded to the jack 1, and the jacket 8. It will be appreciated by those skilled in the art that any means for creating a seal between the jack 1, jacket 8, and bulkhead 3 may be used.

Referring now to FIG. 2, which depicts a preferred embodiment where the bulkhead 3 contains a first orifice 10, a pressure tester in the form of an air valve 11 is installed in the first orifice 10 to allow testing of the hermetic seal during manufacturing and installation. The air valve 11 could, in some embodiments, be inserted into the jacket 8. One method of testing involves pressurizing the jacket-assembly with air to a pressure of 25 psi or less after it is installed on the jack and monitoring the pressure within the jacket-assembly for a pressure drop, which would denote a faulty seal or other breach in the jacket-assembly.

Referring again to FIG. 2, the bulkhead 3 may also include a second orifice 12 to accommodate wires 13 from an optional moisture sensor 14, which can be installed inside the jacket-assembly. A wiring-harness-fitting 15 is inserted into the second orifice 12 and provides a leakproof seal for the wires from the optional moisture sensor 14 to pass through. Like the air valve 11, it is envisioned that in some applications, it may be desirable to install the wiring-harness-fitting 15 in the jacket 8. Various sensors are available for detecting moisture and any sensor suited for this purpose may be used. In one embodiment, the sensor uses copper traces to detect the presence of moisture. If moisture should enter the jacket-assembly and reach a pre-defined level (defined by the distance the sensor is placed from the inside bottom 25 of the jacket 8), an electrical short will be produced across the copper traces. As one option, the sensor may be wired to an elevator controller with the aid of a junction box 16.

While the embodiment described above could be wired to an elevator control system, it is envisioned that a "passive" or "stand alone" version of this system could be used for existing elevators or modernization jobs where it is not desirable or feasible to wire the sensor to an elevator controller. In this embodiment, the presence of moisture may be detected by elevator maintenance personnel using equipment that interfaces with the moisture sensor. One method of testing for moisture within the jacket-assembly is to measure the resistance across the moisture sensor with an ohmmeter. High resistance would tend to indicate the lack of moisture within the jacket-assembly, while low resistance would indicate that moisture has penetrated the jacket-assembly. If moisture is detected within the jacket-assembly, maintenance personnel can replace the jack or remove the moisture and repair the jacket-assembly. Of course, various sensors and devices to monitor those sensors can be used with the present invention. All of which are within the scope of the present invention.

What is claimed is:

1. A jacket-assembly for protecting a hydraulic elevator jack, comprising:

a jacket for covering a portion of the hydraulic elevator jack and creating a space between the jacket and the portion, the jacket manufactured from polyethylene having a density greater than 0.94 gms/cc, and an Izod Impact resistance of greater than 10 ft-lbs/inch; and a seal for hermetically sealing the jacket to the portion.

2. An assembly as in claim 1, further comprising a bulkhead for mounting the jacket to the hydraulic elevator jack, the bulkhead having an upper surface and an outer edge, the bulkhead mounted between the jacket and the hydraulic elevator jack.

3. An assembly as in claim 1, wherein the jacket in manufactured from high density polyethylene tubing having a density of approximately 0.96 gms/cc.

4. A jacket-assembly for protecting a hydraulic elevator jack, comprising:

a jacket for covering a portion of the hydraulic elevator jack and creating a space between the jacket and the portion, the jacket manufactured from polythylene having a density greater than 0.94 gms/cc, an Izod Impact resistance of greater than 10 ft-lbs/in, and a utilization temperature range of between −50° and 180° F.; and a seal for hermetically sealing the jacket to the portion.

5. An assembly as in claim 4, further comprising a bulkhead for mounting the jacket to the jack, the bulkhead having an upper surface and an outer edge, the bulkhead mounted between the jacket and the hydraulic elevator jack.

6. An assembly as in claim 4, further comprising a moisture sensor located in the space between the hydraulic elevator jack and the jacket.

7. An assembly as in claim 4, further comprising a pressure tester for testing the seal.

8. A jacket-assembly for protecting a hydraulic elevator jack, comprising:

a jacket for covering a portion of the hydraulic elevator jack and creating a space between jacket and the portion, the jacket manufactured from polythylene having a density greater than 0.94 gms/cc, an Izod Impact resitances of greater than 10 ft-lbs/inch and a temperature utilization range from approximately −50° to 180° F.; and a seal for hermetically sealing the jacket to the portion.

9. An assembly as in claim 8, further comprising a bulkhead for mounting the jacket to the jack, the bulkhead having an upper surface and an outer edge, the bulkhead mounted between the jacket and the portion of the hydraulic elevator jack.

10. A method for preventing a hydraulic elevator jack from corroding comprising:

encapsulating a portion of the hydraulic elevator jack with a jacket, the jacket manufactured from polyethylene having a density greater than 0.94 gms/cc and Izod Impact resistance of greater than 10 ft-lbs/in.; and hermetically sealing the jacket to the portion.

11. A method as in claim 10, further comprising:

installing a moisture sensor between the jacket and the portion.

12. A method for testing a hermetically sealed jacket-assembly installed on a hydraulic elevator jack comprising:

pressurizing the sealed jack-assembly with a gas, wherein the jacket-assembly comprises a jacket manufactured from polyethylene having a density greater than 0.94 gms/cc and an Izod impact resistance of greater than 10 ft-lbs/in; and monitoring the pressure of the gas within the jacket-assembly to detect a pressure drop within the scaled assembly.

* * * * *

UNITED STATES PATENT AND TRADEMARK OFFICE

CERTIFICATE OF CORRECTION

PATENT NO. : 6,807,893 B2
DATED : October 26, 2004
INVENTOR(S) : Giddens

It is certified that error appears in the above-identified patent and that said Letters Patent is hereby corrected as shown below:

Column 4,
Line 61, “jacket in” should read -- jacket is --.

Column 6,
Line 17, “jack-assembly” should read -- jacket-assembly --.

Signed and Sealed this

Twenty-sixth Day of April, 2005

JON W. DUDAS
*Director of the United States Patent and Trademark Office*